United States Patent [19]

Tanaka et al.

[11] 4,455,656

[45] Jun. 19, 1984

[54] COMBUSTION CONTROL CIRCUIT

[75] Inventors: Toshio Tanaka, Toride; Sumio Nakagawa, Matudo; Kenzi Toudo, Yanai, all of Japan

[73] Assignee: Hitachi, Ltd., Tokyo, Japan

[21] Appl. No.: 212,730

[22] PCT Filed: Feb. 28, 1980

[86] PCT No.: PCT/JP80/00033

§ 371 Date: Nov. 4, 1980

§ 102(e) Date: Nov. 4, 1980

[87] PCT Pub. No.: WO80/01946

PCT Pub. Date: Sep. 18, 1980

[30] Foreign Application Priority Data

Mar. 7, 1979 [JP] Japan ..... 54-25521

[51] Int. Cl.[3] ..... F23N 5/24; G05B 9/02

[52] U.S. Cl. ..... 371/57; 364/505; 431/24; 431/28; 431/45

[58] Field of Search ..... 364/505; 371/4, 12, 371/57; 431/15, 18, 24, 26, 28, 93, 45, 73

[56] References Cited

U.S. PATENT DOCUMENTS

| | | | |
|---|---|---|---|
| 4,192,641 | 3/1980 | Nakagawa et al. | 431/15 |
| 4,239,478 | 12/1980 | Tanaka et al. | 431/24 |
| 4,298,334 | 11/1981 | Clark et al. | 431/24 |
| 4,298,335 | 11/1981 | Riordan et al. | 431/45 X |
| 4,299,557 | 11/1981 | Brouwer | 431/73 X |

FOREIGN PATENT DOCUMENTS

| | | | |
|---|---|---|---|
| 53-67121 | 6/1978 | Japan | 431/18 |
| 53-68443 | 6/1978 | Japan | 431/18 |
| 55-110773 | 3/1980 | Japan | 431/18 |

*Primary Examiner*—Felix D. Gruber

*Attorney, Agent, or Firm*—Antonelli, Terry & Wands

[57] ABSTRACT

A combustion control circuit including semiconductor integrated circuits used for control of a combustor or burner of a water heater, air heater-blower or the like has a very simple configuration for stable initialization against the transient condition of a source voltage. A logic gate performs a sequence control. An input interface section applies a signal to the logic gate in response to an input signal required for combustion control. An output interface section converts the signal produced from the logic gate into a combustion control signal. An operation start signal from an operation switch or a temperature detector circuit is used in combination with an initialization signal for the combustion control circuit. The circuit part associated with the operation start signal making up part of the input interface section is responsive to a higher voltage level supplied from the voltage source during initial operation of the circuit than the logic gate circuit, thus assuring stable initialization without any external parts.

3 Claims, 7 Drawing Figures

COMBUSTION CONTROL CIRCUIT

TECHNICAL FIELD

The present invention relates to a combustion control circuit comprising semiconductor integrated circuits used for control of a combustor or burner of a water heater, an air heater and the like.

BACKGROUND ART

The present invention provides a very simple configuration for stable initialization against the transient conditions of the source voltage.

The normal operation of the combustion control device is as follows. When the source voltage is supplied to the combustion control circuits, at first the blower is operated to prepurge the combustion chamber, drawing off the gas which remains in the combustion chamber, and after a predetermined time interval, the fuel supply device and the igniter are actuated, so that the igniting action is accomplished.

In conventional combustion control circuits, in the performance of these operations in proper sequence at the time of first application of power, the state of each flip-flop in the integrated circuits is randomly determined against a transient condition of the source voltage supplied to the semiconductor integrated circuits. In other words, the operation start signal for an operation switch or the like is provisionally reset after the source voltage is supplied for the purpose of initialization of the circuits.

A typical system will be described with reference to FIG. 1. The description below concerns a configuration for combustion control of a combustor.

Semiconductor integrated circuits for combustion control generally comprise a logic gate section 2 including a timer for taking a timing of combustion control and a logic circuit for generating various output signals in response to a signal from the timer and an input signal, an input interface section 1 for applying to the logic gate section 2 such signals as those from an operation switch, a flame detection signal and a fault alarm input (not shown) required for combustion control, and an output interface section 3 for amplifying the signal from the logic gate section 2 and driving the load such as a combustion blower or a solenoid valve (not shown). The input interface section 1, the logic gate section 2 and the output interface section 3 are connected to a common power supply Vcc as a voltage source. The logic gate section 2 typically comprises integrated injection logic (IIL); whereas, the input interface section 1 and the output interface section 3 comprise bipolar transistors.

When the source voltage Vcc is applied to the integrated circuits, a voltage change occurs with time as shown in the waveform of FIG. 2. Although the rise time T is actually very short (on the order of milliseconds) and apparently represents a sharp rise, the electronic circuit responds to this transient condition. The circuit, which is not actuated by a low voltage Vcc, begins to be actuated from a certain potential depending on the circuit configuration. The parts having the same circuit configuration are actuated at the same time. Memory elements such as flip-flops, therefore, are settled in a given condition depending on a slight difference in charges or voltage of the transistors making up the circuit. This condition is not always representative of the same mode and therefore the operation of these circuits is very unstable.

As the logic condition of each of the circuits is randomly determined when each of the circuits is activated after the transient condition of the source voltage, the output interface section may be undesirably operated before the initialization of the circuits is completed. This results in a chattering of the output signal from the control circuits when the source voltage is supplied. In a combustion control circuit, at the time of application of the source voltage, namely at the initial state of the circuits, all output signals of the circuits must reflect an "off state" condition; otherwise, malfunctions may occur in the circuit. For example, if the igniter is momentarily operated by the chattering of the output signal, in the case where gas remains in the combustion chamber, an explosuion may occur. Also, the combustion control circuit generally includes an alarm device which is operated in case of a malfunction to provide an alarm and stop the operation of the blower and the fuel supply device. Under these conditions, the blower and fuel supply device are controlled so that they cannot be undesirably restarted during the operation of the alarm device. Thus, where the alarm device is actuated due to a malfunction during initialization of the combustion control circuit, the entire system is effected.

It is thus necessary to apply a signal for resetting the whole of the logic circuit 2 through the input interface 1 after the source voltage is established, thereby complicating the circuit configuration.

SUMMARY OF INVENTION

Accordingly, it is the object of the present invention to provide a combustion control circuit in which the combustion start signal from an operation switch or a temperature detector circuit or the like is used in combination with the initialization signal from the combustion control circuit so that the source voltage response level of the circuit for the combustion control start signal making up part of the input interface section may be higher than that of the logic gate section, thus ensuring stable initialization under all conditions without any external parts being added to the semiconductor integrated circuit.

BEST MODE FOR CARRYING OUT THE INVENTION

Figure 1:
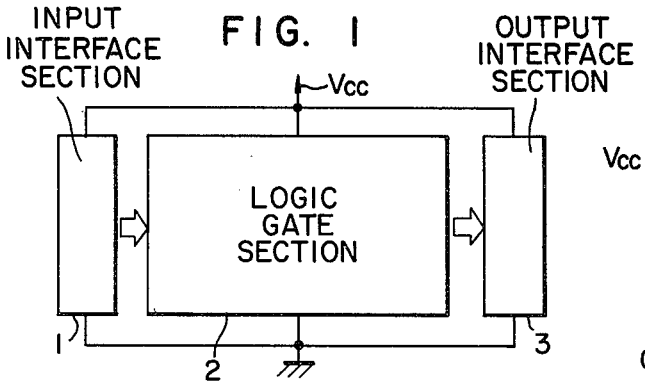
FIG. 1 is a block diagram showing conventional semiconductor integrated circuits.
Figure 2:
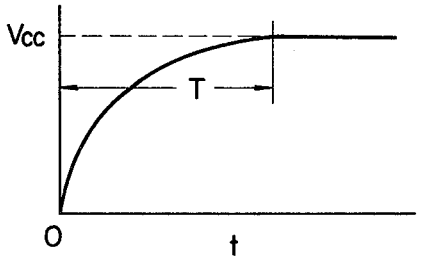
FIG. 2 shows a waveform representing the transient condition of the source voltage.
Figure 3:
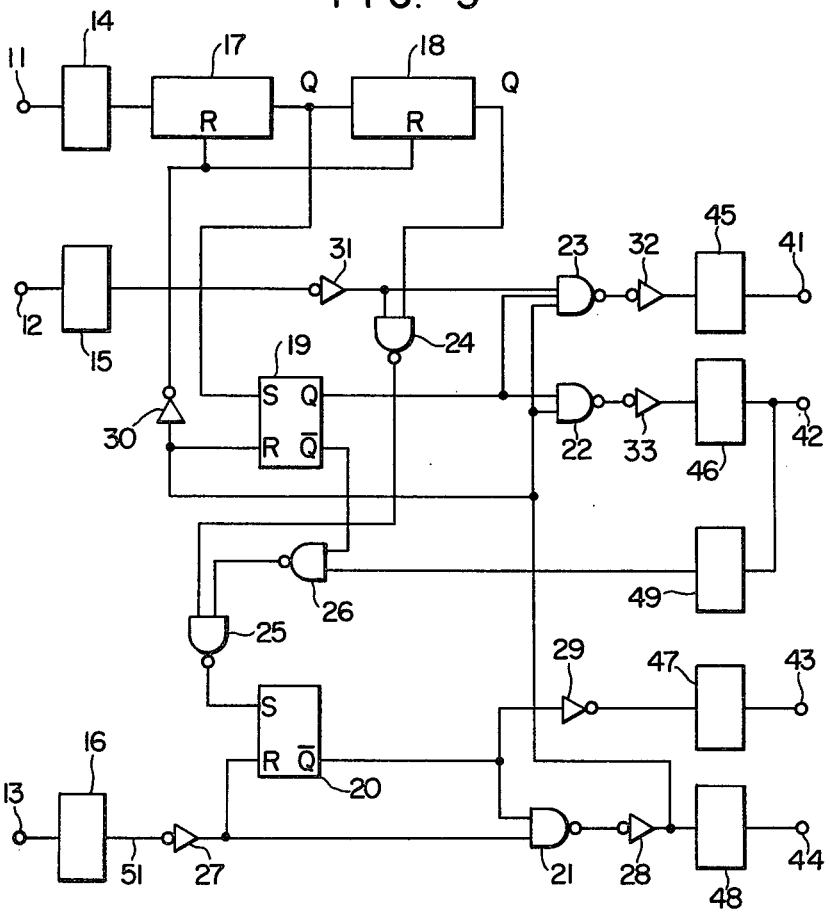
FIG. 3 is a diagram showing an example of the combustion control circuit.

First, an example of the combustion control integrated circuits will be described with reference to FIG. 3. Reference numeral 11 shows a clock pulse input terminal, and numeral 12 a flame signal input terminal which is supplied with an L level in the presence of a flame. Numeral 13 shows an input terminal for a load temperature signal making up an operation start signal. This input terminal is supplied with an H level at a low temperature from a temperature detector circuit. Numerals 14, 15 and 16 show input interface circuits, of which the circuit 16 is for producing an operation start signal.

Numeral 17 shows a pre-purge timer for counting the pre-purge time and includes a T flip-flop. Numeral 18 shows a safety timer for determining the time at which decision is made on non-ignition, and includes a T flip-flop. Numeral 19 shows an RS flip-flop for storing the end of a pre-purge time. Numeral 20 shows an RS flip-flop for storing a non-ignition output. Numerals 21 to 26 show NAND gates, and numerals 27 to 33 identify inverters.

Numeral 41 shows an output terminal for driving an ignition device, numeral 42 an output terminal for driving a fuel supply device, numeral 43 an output terminal for driving an alarm, and numeral 44 an output terminal for driving a blower. These output terminals 41 to 44 are provided to drive the load at "L". Numerals 45, 46, 47 and 48 show output interface circuits.

Numeral 49 is an input interface circuit for checking to see whether the conduction of the transistor of the output interface circuit 46 for driving the fuel supply device has failed or not. In other words, an "H" signal is produced when the output terminal 42 is at "L".

In this configuration, assume that the operation switch is turned on. When the temperature is low, the input terminal 13 receives a signal at the level "H", and therefore the input interface circuit 16, namely, the operation start signal circuit is at a level "L". The RS flip-flop 20 changes from the reset condition to the set condition. The output of NAND gate 21 is reduced to the level "L", the output of inverter 28 is raised to the level "H", and the output of interface circuit 48 is reduced to the level "L", thus driving the blower. This starts the pre-purge. On the other hand, the timers 17 and 18 are released from the reset state, so that the pre-purge time begins to be counted in response to the clock pulses from the input terminal 11. Also, the RS flip-flop 19 is released from the reset state.

After the lapse of a predetermined length of time, the "H" state of the output of the pre-purge timer 17 causes the RS flip-flop 19 to be set, so that the output Q is raised to "H". The ignition device starts to be driven through the output terminal 41, and the fuel supply device through the output terminal 42. This starts the ignition operation. On the other hand, the safety timer 18 begins to count.

When the ignition is accomplished, the input terminal 12 is reduced to "L", and therefore the ignition device is stopped.

When the temperature increases and an "L" signal is applied to the input terminal 13, the output of the input interface circuit 16 is raised to "H", thus stopping the operation. Specifically, when the output of the input interface circuit 16 is "H", the logic gate section is reset.

In the case where ignition is not accomplished within the safety time, the output of the safety timer 18 causes the output of the NAND gate 24 to be reduced to "L" and the output of the NAND gate 25 to be raised to "H", thus setting the RS flip-flop 20. The output of NAND gate 21 is reversed thereby stopping the blower and the fuel supply device. Also, the alarm is actuated through the output terminal 43.

When the output of the output interface circuit 46 is at "L", the output of the input interface circuit 49 is at "H". In the case where this "H" signal appears during the pre-purge, it indicates that the interface circuit 49 is out of order. Then the NAND gate 26 is reduced to "L", and the RS flip-flop 20 is set thereby to stop the combustion operation.

Figure 4:
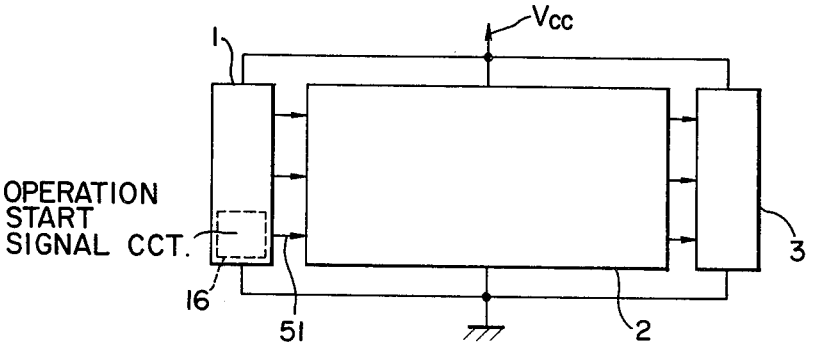
FIG. 4 is a block diagram of the combustion control circuit.

The present invention will be described below with reference to the schematic diagram of FIG. 4. A configuration not including the input interface circuit 49 of FIG. 3 will be involved.

The signals produced from the input interface section 1 are applied to the logic gate section 2, in which the signals are transformed into control signals and applied to the output interface section 3 as in conventional systems. The circuit is so constructed that when considering the response to the source voltage Vcc, the operation of the logic gate section 2 first becomes active followed by the input interface section 1 and the output interface section 3. In this case, among the parts of the input interface section 1, the operation start signal circuit 16 is the last circuit which is made active so that the operation start signal output 51 will not be produced during the transient state of the source voltage Vcc. The activating timing of the other circuits in the input interface section is arbitrary. This construction is realized by appropriately determining the constants of each circuit.

Figure 5:
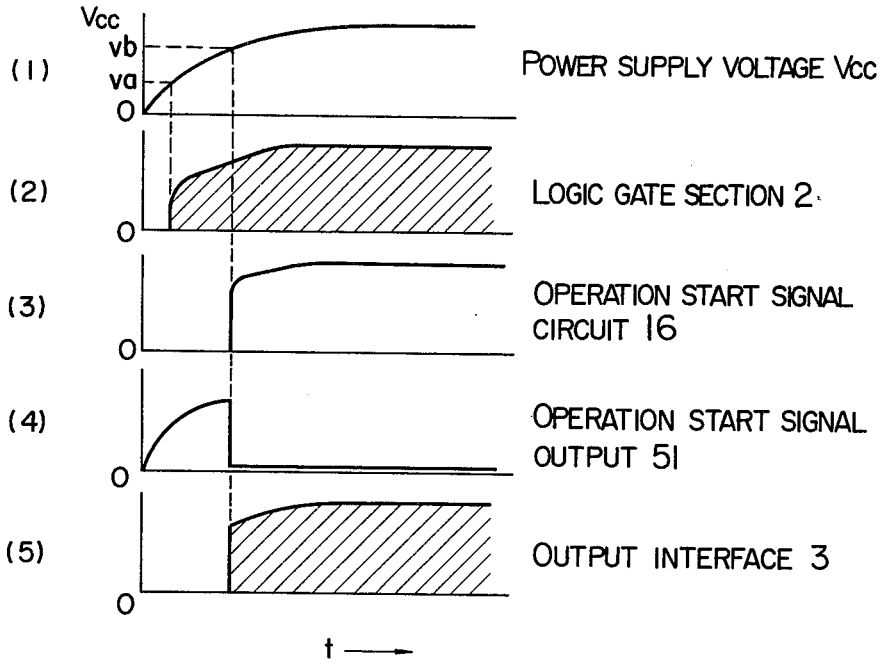
FIG. 5 show waveforms produced from various parts in transient state.

The waveforms and timing of signals produced at each part of the system are shown in FIG. 5. With the gentle increase in the source voltage Vcc, the operating condition of the logic gate section 2 is determined at low level, followed by the determination of the condition of the input and output interface sections 1 and 3. The operation start signal circuit 16 produces a signal output 51 at the level "H" in the form of an initialization signal for designating the resetting operation (stopping operations) in the time interval from the time the logic gate section 2 is activated at the voltage level Va to the time the operation start signal circuit 16 is activated at the voltage Vb, as seen in FIG. 5. The logic gate section 2 receives the output 51 at the level "H" and becomes reset so as to produce an output signal indicating the reset state to the output interface section 3, while the output interface section 3 produces an output signal indicating the reset state of the operation until the voltage source Vcc rises to the voltage Vb. Therefore, the igniter, fuel supply, blower, etc., are not driven. Subsequently, the operation start signal output 51 is changed to the level "L" for canceling the reset state of the logic gate section 2 when the source voltage Vcc exceeds the voltage Vb, so that the logic gate section 2 starts operating with application of this operation start signal. The shadowed parts of (2) and (5) of FIG. 5 show that the logic output condition may be either "L" or "H".

Figure 6:
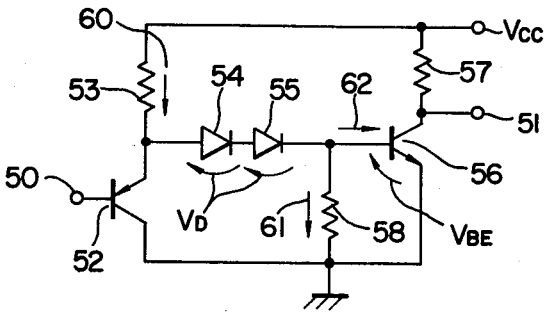
FIG. 6 is a circuit diagram showing the input interface section according to an embodiment of the present invention.

Next, an embodiment of the circuit for generating the waveform (4) of FIG. 5 is shown in FIG. 6. The input terminal 50 is for receipt of the signal designating the start and stop of the operation of combustion control. The "L" state of the input signal at this terminal indicates the stoppage, namely, the resetting of the whole circuit, and the "H" level thereof indicates an operation start and continuation.

Assuming that the voltage rises with the source voltage Vcc when the applied signal is at the "L" level at the input terminal 50, the circuit is reset when the source voltage reaches a steady state, thus posing no problem.

Therefore, the operation of the operation start signal output 51 in association with the setting of the input terminal 50 at the level "H" will be described. The output 51 is so constructed that it is at the level "H" when the source voltage is supplied. The input terminal 50 is connected to the base of the PNP transistor 52. The collector of the transistor 52 is grounded, and the emitter thereof is connected to a power supply through the load 53. The output from the emitter of the transistor 52 is connected to the base of the NPN transistor 56 through the level shift diodes 54 and 55. The emitter of the transistor 56 is grounded, and the collector thereof is connected to the power supply through a load resistor 57. The operation start signal output 51 is produced from the collector of the transistor 56. A base resistor 58 is inserted between the base and emitter of the transistor 56.

In this configuration, description will be made of the case in which the input terminal 50 is at the level "H" and the source voltage Vcc is steady. The emitter of the PNP transistor 52 making up an output thereof is at the level "H", and therefore the current 60 flowing through the load resistor 53 is divided into the current 61 flowing from the level shift diodes 54 and 55 through the base resistor 58 and the base current 62 of the NPN transistor 56, thus turning on the NPN transistor 56. Under this condition, the operation start signal output 51 is at the level "L".

Now, the transient condition of the source voltage Vcc will be discussed. In order to turn on the NPN transistor 56, the base current 62 is required to be supplied to the transistor. Unless the voltage drop across the load resistor 58 due to the current 61 flowing through the load resistor 58 is larger than the base-emitter forward bias voltage $V_{BE}$ of the NPN transistor 56, the base current 62 fails to flow. In similar fashion, the base current 62 plus the current 61 flows through the level shift diodes 54 and 55, so that the potential of the emitter of the PNP transistor 52 is affected by the voltage drop across the level shift diodes 54 and 55. It is thus required that a potential higher than the sum of the forward voltage drop $V_D$ across the diodes and the base-emitter forward bias voltage $V_{BE}$ is produced at the emitter of the PNP transistor 52. Generally, the base-emitter forward voltage $V_{BE}$ and the forward voltage drop $V_D$ across the diodes is approximately 0.6 to 0.7 V at normal temperature. Therefore, to the extent that the emitter potential of the PNP transistor 52 is increased to 1.8 to 2.1 V, it is impossible to produce an operation start signal at the level "L" at the output 51.

Until the source voltage $V_{cc}$ increases slowly and reaches 1.8 to 2.1 V, therefore, the NPN transistor 56 is kept off, so that the operation start signal output 51 also increases with the source voltage. Since the input terminal 50 is at the level "H", the emitter potential of the PNP transistor 52 also increases with the source voltage Vcc and when it exceeds the level of 1.8 to 2.1 V, part of the current 60 flowing in the load resistor 53 takes the form of the base current 62 for turning on the NPN transistor 56. As a result, the waveform as shown in (4) of FIG. 5 is obtained.

Figure 7:
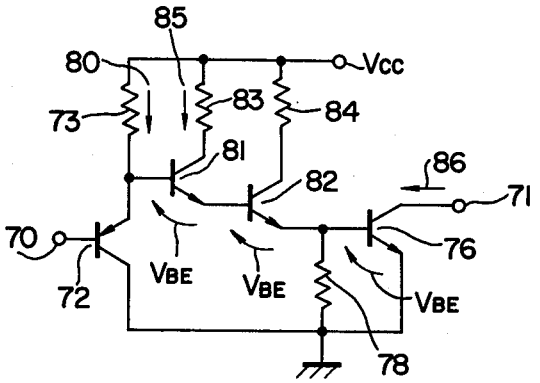
FIG. 7 is a circuit diagram showing the interface section according to an embodiment of the present invention.

The same can be said of the output interface section 3. In view of a comparatively large current capacity required of the output transistor, the circuit configuration using an NPN transistor as shown in FIG. 7 is employed in place of the level shift diodes 54 and 55.

The input terminal 70 supplied with the output of the logic gate section 2 is connected to the PNP transistor 72, the emitter of which is connected with a load resistor 73. The base of the NPN transistor 76 having an output terminal 71 is provided with a base resistor 78. The current 80 flowing in the load resistor 73 becomes the base current of the transistor 81, and therefore drives the current 85 flowing through the load resistor 83. Further, this current 85 takes the form of the base current of the transistor 82 and is amplified. The base current of the output transistor is supplied through the load resistor 84, the resistance value of which determines the collector current 86 of the transistor 76.

The base-emitter voltage $V_{BE}$ of the transistors 81 and 82 which exists also in this case is substantially equal to the forward voltage drop $V_D$ of the diode, and therefore the circuit functions the same way as the above-mentioned input interface section 1 against the transient condition of the source voltage Vcc.

Further, this circuit is such that the transistor 76 is kept off until the source voltage Vcc reaches 1.8 to 2.1 V. Accordingly, the operating level of the logic gate section 2 corresponds to the voltage source Vcc at a low level value lower than 1.8 to 2.1 volts and is lower than the operating level of the operation start signal circuit 16, as already mentioned above. Therefore, the logic gate section 2 can be operated by a low voltage value lower than 1.8 to 2.1 volts, when the voltage source Vcc rises. The operation start signal output 51 is at the level "H" so that the logic gate section 2 is maintained in the reset state, until the voltage source Vcc rises to 1.8 to 2.1 volts, whereby the inverters 32, 23, 29 and 28 are at the level "L". Further, when the voltage source Vcc exceeds 1.8 to 2.1 volts, the operation start signal output 51 is at the level "L" and the reset state of the logic gate section 2 is canceled. Accordingly, the inverter 28 is placed at the level "H" and the inverters 32, 23 and 29 are retained at the level "L". On the other hand, the transistor 76 for the output of the output interface section 3 is maintained in the off state until the source of voltage Vcc reaches 1.8 to 2.1 volts, then the logic level of the input terminal 71 is already determined.

When the source voltage Vcc exceeds 1.8 to 2.1 volts, the logic level of the input of the input terminal 70 is always established by the level "L" of the operation start signal output 51. The level of the input terminal 70 of the output circuit 48 of the blower is at the level "H", then, the transistor 76 turns on and the prepurge operation is started. On the other hand, the level of the input terminal 70 of the output circuit 45 of the igniter is at the level "L", therefore, the transistor 76 is maintained in the off state, and the chattering common in prior art circuits does not occur.

Further the state of the logic gate section 2 is the reset state as a result of the operation start signal circuit 16 until the voltage source Vcc exceeds 1.8 to 2.1 volts, so that the activating timing of the other input interface circuit is arbitrary.

The input interface circuit 49 for checking the output interface section 3 is similar to that shown in FIG. 6, except that the condition of the input interface circuit 49 is required to be established earlier than that of the operation start signal circuit 16.

We claim:

1. In a combustion control circuit including semiconductor integrated circuits responsive to a supply voltage from a power supply and having a logic gate section for performing a sequence control by generation of logic signals in response to a start signal, an input interface section for applying said start signal to said logic gate section in response to an input control signal required for combustion control, and an output interface section for converting the logic signals produced from the logic gate section into output control signals including a combustion control signal; the improvement wherein said input interface section includes means responsive to said input control signal for generating said start signal which is enabled at a higher predetermined voltage level of said supply voltage than is said logic gate section, so that upon initial application of said supply voltage from said power supply said logic gate section is enabled prior to said start signal generating means.

2. A combustion control circuit according to claim 1, wherein said start signal generating means comprises means for preventing generation of said start signal in response to said input control signal until said supply voltage exceeds said predetermined voltage level.

3. A combustion control circuit according to claim 1, wherein said start signal generating means comprises means for generating a reset signal in place of said start signal until said supply voltage exceeds said predetermined voltage level, said logic gate section including means responsive to said reset signal for inhibiting combustion control.

* * * * *